US005445305A

United States Patent [19]

Jöhr et al.

[11] Patent Number: 5,445,305

[45] Date of Patent: Aug. 29, 1995

[54] METHOD AND DEVICE FOR FEEDING A BAND OR STRIP ALONG A STRAIGHT OR ZIG-ZAG COURSE TO A MACHINE SUCH AS ONE FOR CUTTING OUT OF BLANKS

[75] Inventors: Hans Jöhr, Kehrsatz; Roland Krebs, Fraubrunnen, both of Switzerland

[73] Assignee: Styner & Bienz AG, Niederwangen, Switzerland

[21] Appl. No.: 181,880

[22] Filed: Jan. 13, 1994

Related U.S. Application Data

[63] Continuation of Ser. No. 794,917, Nov. 20, 1991, abandoned.

[30] Foreign Application Priority Data

Nov. 23, 1990 [CH] Switzerland ..... 03709/90

[51] Int. Cl.[6] ..... B65H 20/24; B26D 3/00; B65G 23/00

[52] U.S. Cl. ..... 226/112; 83/277; 83/50; 198/832.1

[58] Field of Search ..... 226/108, 112, 158, 160, 226/16, 18, 19; 83/36, 50, 277, 421; 198/832.1

[56] References Cited

U.S. PATENT DOCUMENTS

| | | | |
|---|---|---|---|
| 2,126,453 | 8/1938 | Criley et al. | 226/112 X |
| 2,126,455 | 9/1938 | Criley et al. | 226/112 X |
| 3,583,268 | 6/1971 | Scribner | 226/112 X |
| 3,665,794 | 5/1972 | Wiig | 83/50 X |
| 3,791,567 | 2/1974 | Schott, Jr. | 226/112 |
| 3,847,320 | 11/1974 | Scribner | 226/115 |
| 4,051,987 | 10/1977 | Scribner | 226/115 |
| 4,160,518 | 7/1979 | Scribner | 226/115 |
| 4,348,924 | 9/1982 | Jenkner | 83/277 X |
| 4,610,380 | 9/1986 | Plumb | 226/162 X |

FOREIGN PATENT DOCUMENTS

| | | |
|---|---|---|
| 0321602 | 6/1989 | European Pat. Off. . |
| 2158074 | 10/1971 | France . |
| 2237698 | 7/1974 | France . |
| 2534914 | 8/1975 | Germany . |
| 1045699 | 10/1966 | United Kingdom . |

*Primary Examiner*—Daniel P. Stodola
*Assistant Examiner*—Michael R. Mansen
*Attorney, Agent, or Firm*—Marks & Murase

[57] ABSTRACT

Method and device for feeding a band or web into a downstream machine, including two grips that serve for the stepwise advancing of the band, the grips moving in synchronism to and fro in opposing directions. The grips are alternately coupled with the band or web each during its course in a determined direction in order to impart to the latter a zigzag advancing motion. The driving frequency of the advancing device is in this case half as high as the cadence of the following tool and very high cadences can be achieved.

14 Claims, 4 Drawing Sheets

METHOD AND DEVICE FOR FEEDING A BAND OR STRIP ALONG A STRAIGHT OR ZIG-ZAG COURSE TO A MACHINE SUCH AS ONE FOR CUTTING OUT OF BLANKS

This application is a continuation of application Ser. No. 07/794,917 filed Nov. 20, 1991, now abandoned.

BACKGROUND OF THE INVENTION

In a known device and method for cutting or punching out blanks or circular discs for further processing into drawing parts, a band of strip (generically referred to as a web) is advanced stsepwise. If a series of blanks are to be cut out from a band, the advance takes place stepwise in the longitudinal direction of the band. However, if at least two series of blanks are to be cut out at locations displaced in the longitudunal and transversal direction, in order to improve the utilization of the band, the latter must be advanced in a zigzag or a sawtooth manner.

Generally, the advance takes place by means of a grip which in the simplest case advances stepwise the band in its longitudinal direction. This grip must execute a backward motion between consecutive cutting operations, must seize the band and advance the latter. It must thus execute a double displacement and still further change the direction of the motion. In the case of zigzag advancing of the band, a combined longitudinal and transversal advance is necessary which leads to complicated, expensive constructive solutions which do not even permit any higher working speed.

From EP-A-0 321 602, it is known to drive two grips to and fro movable in the advancing direction from a common driving pinion through toothed racks and to advance the band stepwise by alternate couplings with one of the grips during its motion in the advancing direction. Except for that this device is only appropriate for an advance in the direction of the band, the drive is executed by means of an expensive mechanism which does not permit a very high number of strokes.

SUMMARY OF THE INVENTION

It is an object of the present invention to permit by means of alternate acting first and second grips, a feed with a very high number of steps, together with a simple construction and a simple control. The solution is that one transforms a motion directed transverse to the general feeding motion of a common drive to a working motion of inclined motions of the grips. A device for carrying out this invention comprises a common to and fro movable driving element which is coupled via a coupling member with the grips which are guided along respective guide, in directions which with respect to the direction of the driving motion form an angle up to 90°. The deviation of the motion from the drive to the grips can take place for any angle up to 90° by means of sliding coupling elements or twistable rods. The transport can take place straight lined in the longitudinal direction of the band when only one series of blanks is cut, or the transport can take place zigzagwise in that both grips are moved in one direction which is inclined to the longitudinal direction of the band or perpendicular to the latter. This results in a simple construction and a simple synchron motion and control with relatively few movable masses and one can achieve cutting cadences up to e.g. 300/min. As will be seen later on, practically no limits are set to the course of the motions.

The invention will be explained further by means of the drawings of two examples of execution.

DETAILED DESCRIPTION OF THE INVENTION

Figure 1:
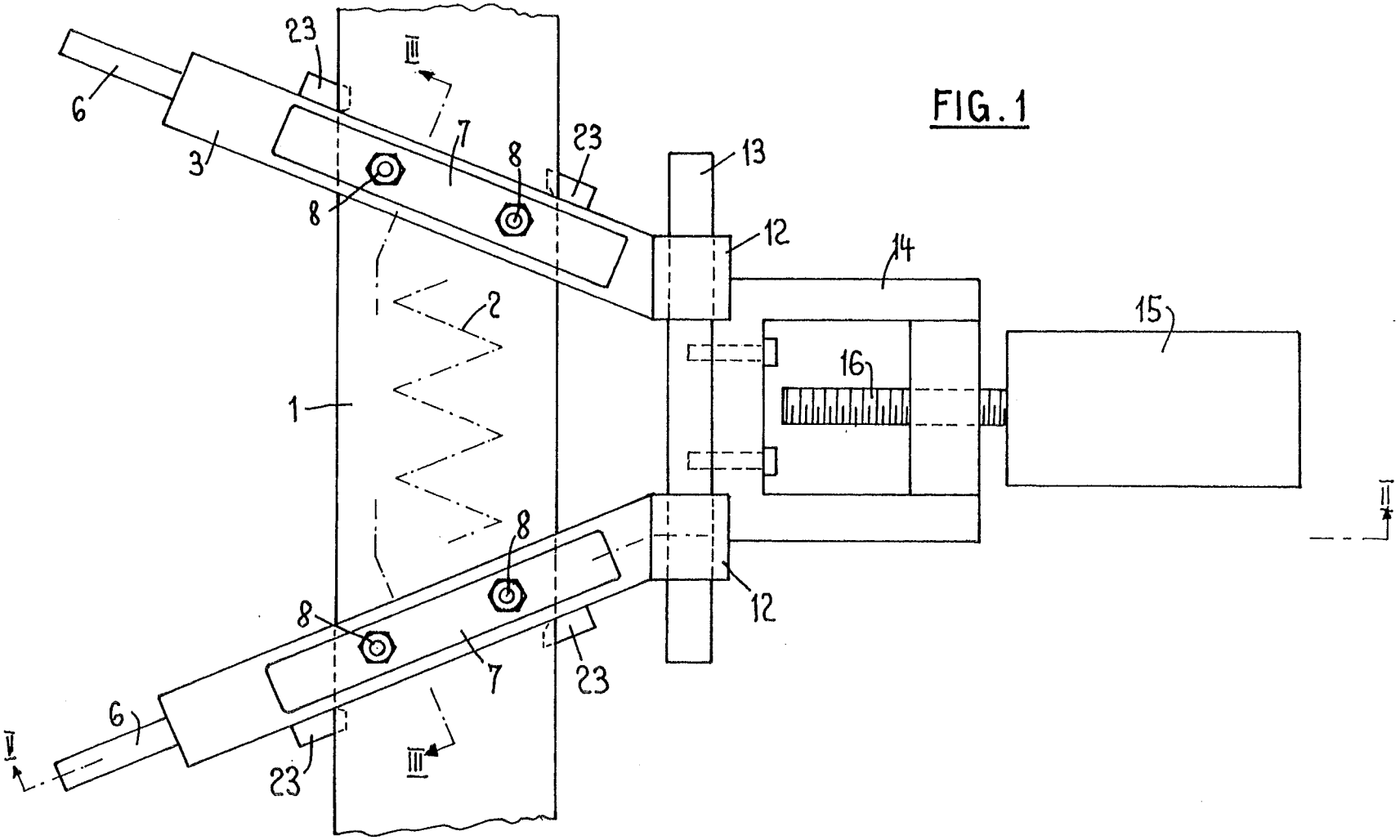
FIG. 1 is a plain view of a first embodiment of the present invention.
Figure 2:
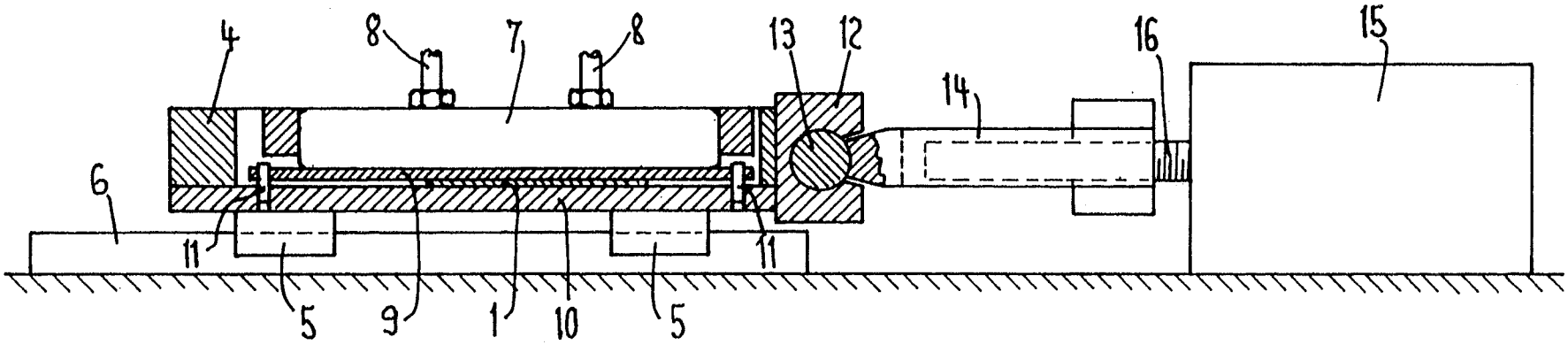
FIG. 2 is a section along the line II—II of FIG. 1.
Figure 3:
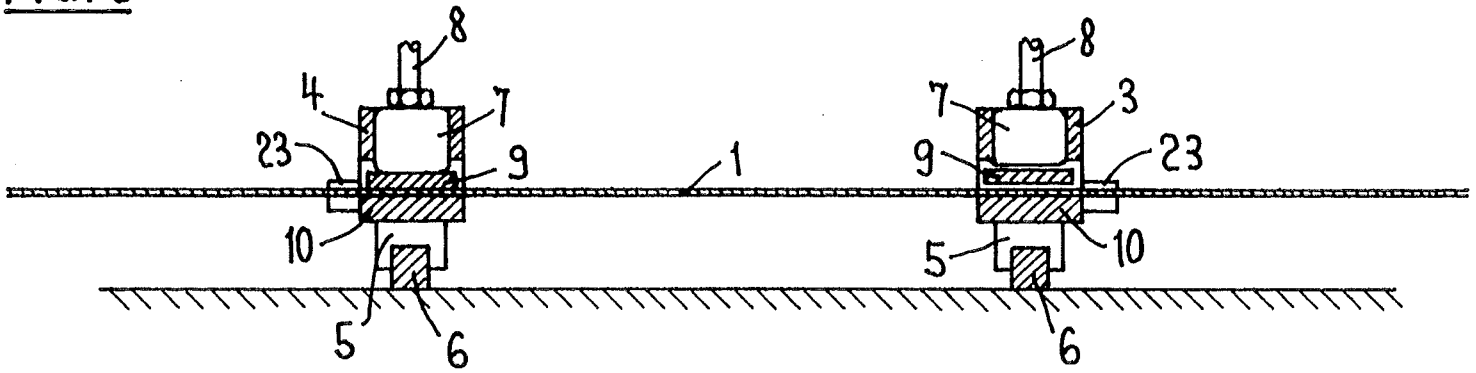
FIG. 3 is a section along the line III—III of FIG. 1.

FIG. 1 shows the web or band 1 to be transported from which blanks, e.g. circular discs are to be cut out by means of a cutting tool. A zigzag line 2 in FIG. 1 indicates the manner in which the band is to be transported in order for the blanks to be punched out in two rows in longitudinal and transverse displaced locations, to achieve an optimal utilization of the material. This zigzag path of the transport of the band is achieved by means of first and second grips 3 and 4 of the same kind. These grips are in the form of oblong slides which are guided by means of U-guides 5 along first and second guiding rails 6 which, as shown in FIGS. 2 and 3, are fastened to the machine frame. The two grips 3 and 4 can also be moved along the guiding rails 6 in a direction which is inclined with respect to the longitudinal or forward feed direction of the band 1, approximately 60°, such that both guiding rails 6 are inclined in opposite directions and each of the grips 3 and 4 also enclose an angle of 60°. The two grips each comprise an air cushion 7 to which pressurized, pulsed air is supplied through flexible leads 8 in order to clamp a clamping rail 9 against the band 1, which is shown between the clamping rail 9 and the bottom 10 of the grips, to ensure the transport. The clamping rails 9 are movable vertically and are guided by guiding screws 11.

Each of the grips comprises a slotted coupling box 12 which is supported on a coupling rod or member 13 along which it can slide. The coupling rod 13 is connected to a driving frame 14 which, by means of a driving motor 15 through a spindel 16, is movable to and fro in the direction of the axis of the spindel 16 in order to move to and fro the grip 4 over the coupling boxes 12, along their guides 6. The grips 3 and 4 each comprise two band guides 23.

The working of the illustrated transporting device follows largely from the above description. By means of the driving motor 15, both grips 3 and 4 are moved to and fro in opposing directions relative to one another in synchronism. By each course of this motion, one of the grips 3 or 4 receives compressed air in order to couple or engage it with the band 1 by pressure of the clamping rail 9 and to carry along the same in the direction of motion of the grip concerned. This situation is indicated in FIG. 3, that is the clamping rail of the grip 4 is pressed pneumatically against the band 1, so that the latter must follow the motion of the grip 4. In this way, the band is alternately advanced in the direction of the motion of the grip 3 when the grip 3 is in engagement with the band and moving in the forward feed direction, and in the direction of the motion of the grip 4 when the grip 4 is in engagement with the band and moving in the forward feed direction. The guides 23 provided to the grips 3 and 4 provide for a straight guiding of the band in the region of the transporting device so that the band is also always brought in the right position to the cutting tool, not represented. The drive of the grips 3 and 4 by means of a controlled electromotor 15 permits a very simple programming of the efflux of the motion, that is of the course of the motion and of the tact of the motion as well as of the precise time interval during which the band is advanced. Another drive, e.g. a pneumatic drive is also possible.

Figure 4:
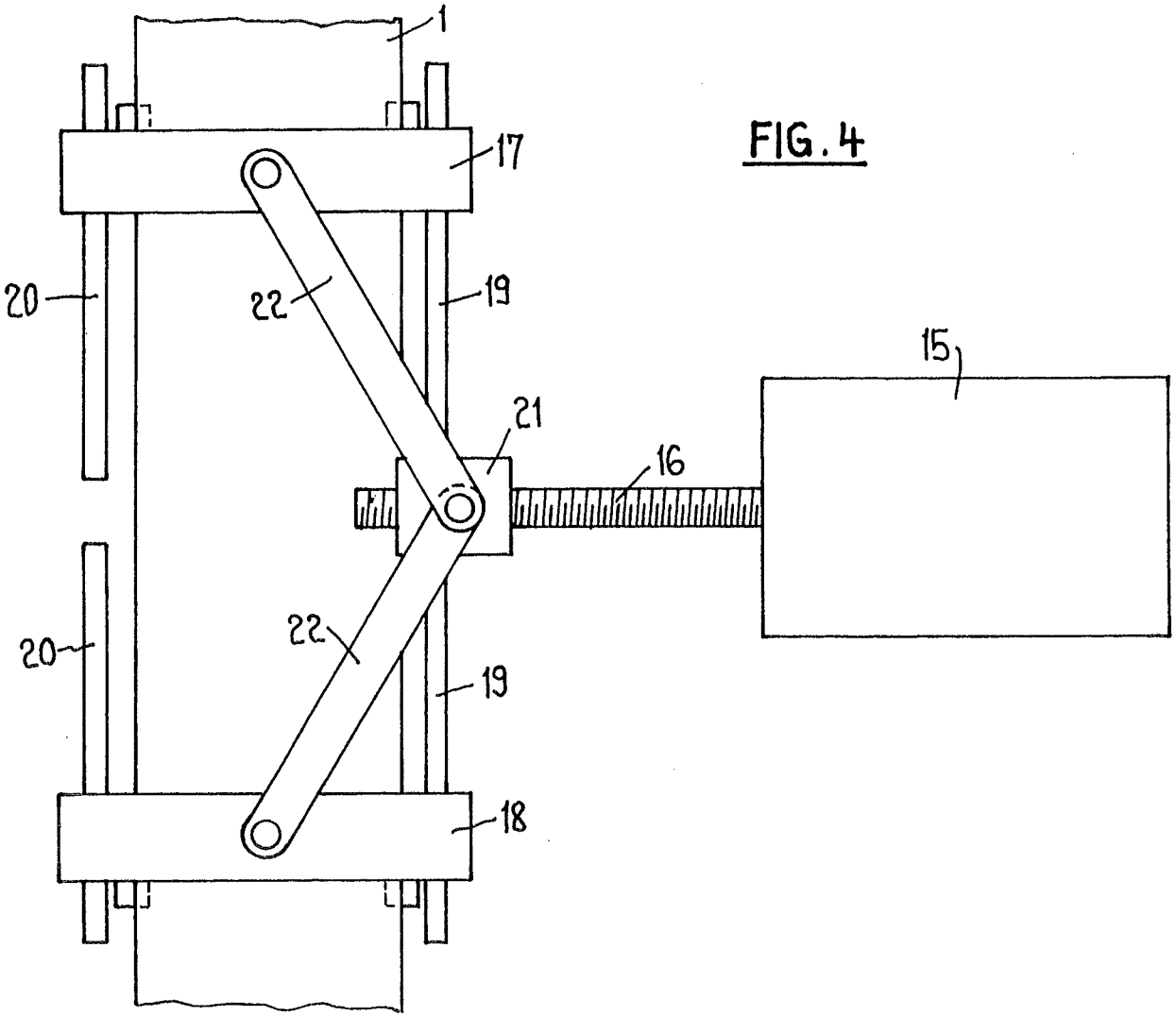
FIG. 4 is a schematic plain view a second embodiment of the present invention and FIGS. 5 to 8 show possibilities for cutting of blanks in more than two series.
Figure 5:
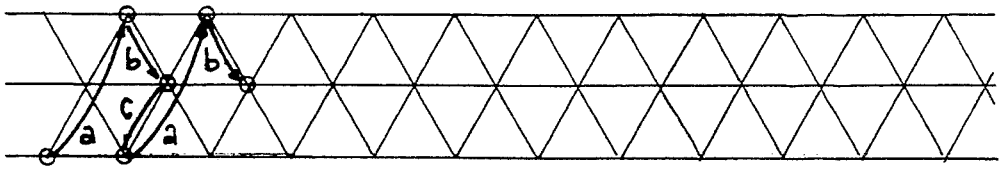
Figure 6:
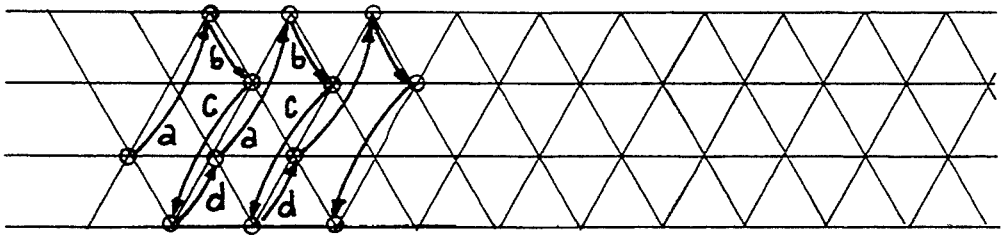
Figure 7:
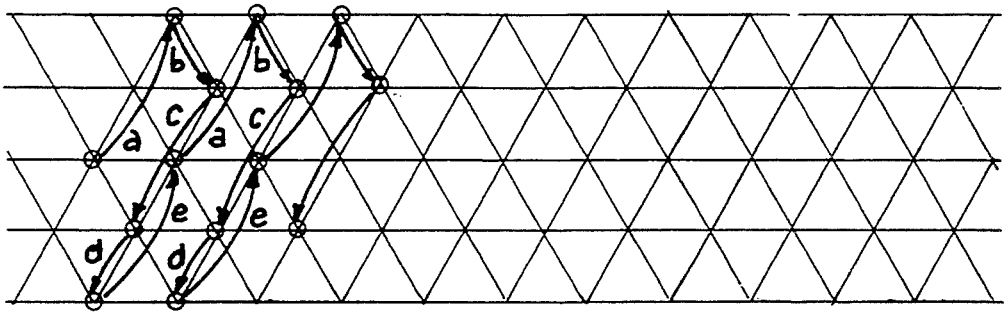
Figure 8:
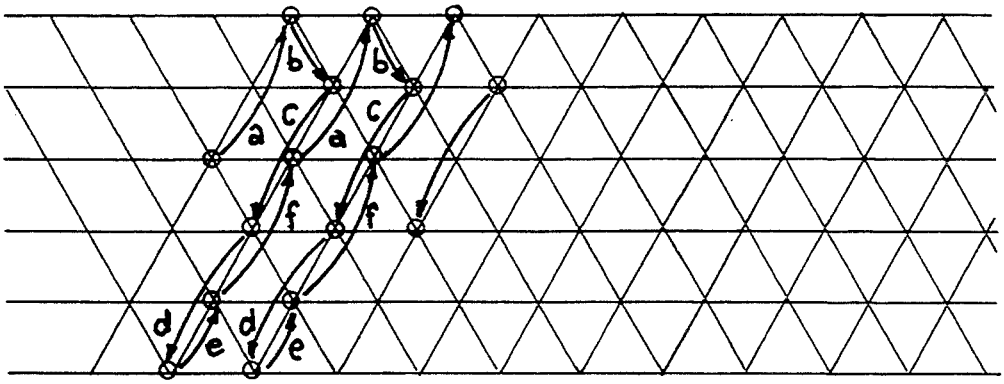

FIG. 4 schematically illustrates a second embodiment of the present invention. Two grips 17 and 18 are used which are displaceable along guiding rails 19 and 20 in the longitudinal direction or forward feed direction of the band 1. They can be moved in push-pull by means of a motor 15, the spindel 16, a pinion of spindel 21 and coupling rods 22. During displacement in the desired advance direction of the band 1 the grip 17 or the grip 18 are coupled with the band in a manner already described in order to advance the latter one step. In addition each grip 17 or 18 excutes only one step in a direction for advancing the band one step and during the next advance of the band it is moved back to its initial position. Further, with this embodiment a particularly high working cadence can be achieved, in the first place because the inertia forces of the grips 17 and 18 compensate mutually.

Other forms of execution are possible. In the example of FIGS. 1 to 3, it is admitted that the grips 3 and 4 are rigidly coupled with their coupling boxes 12 such that the angle which is enclosed by the directions of motions of both grips is not variable. It would be possible, however, to render at least one of the grips and its associated guide rail 6 adjustable with respect to its coupling box 12, as shown in FIG. 9. In this case, one of the grips 3 or 4 could be placed perpendicularly to the longitudinal or forward feed direction of the band while the other one of the grips is inclined to the forward feed direction in order to impart to the band a sawtooth advancing motion.

While a zigzagwise advancing of the band is practically significant only in relation with a cutting tool for cutting of blanks, a straight advance according to FIG. 4 can be used in correspondance with another tool, e.g. a follow-on tool.

It is mentioned above that the drive of the grips by means of a controlled motor 15 renders possible a versatile control of the motion by means of appropriate software. In such a case the course of the grip can more particularly be freely selected. FIGS. 5 to 8 show the possibilities for cutting blanks in more than two rows of blanks by means of appropriate control of the course and the efficacy of the grips 3 and 4. In these figures, the single courses, the cyclic order of the steps in the different cutting positions, are designated by a to f. FIGS. 5 to 8 show that alternately double and single steps are executed in order to reach only one time each cutting position. By cutting blanks in two rows according to FIG. 1, numbers of courses up to 300/min are possible. By cutting in more then two rows according to FIGS. 5 to 8, a number of courses up to 200/min. is achieved because double steps have to be excuted.

Further forms of execution are possible. Preferably, a driving unit appropriate for all needs can be present which would be detachable with interchangeable carriage units coupled with the grips. In this case it is specially advantageous that different advancing module units be mounted in accordance with the needs while the same driving unit can always be foreseen. This is more particularly possible when the driving unit can operate in the described manner with any courses and number of courses due to the electronic control.

The running of the motions are not limited, so that e.g. a straight lined advance can be executed by two inclined zigzag steps.

We claim:

1. A device for feeding a web in a forward feed direction, comprising;

first and second moveable grip means for alternately engaging and advancing the web in said forward feed direction, wherein said first and second grip means move in opposing directions relative to one another such that as one grip means moves in the forward feed direction the other grip means moves in a direction opposite the forward feed direction, each grip means engaging the web during movement in the forward feed direction and releasing the web during movement in the direction opposing said forward feed direction;

first and second guide means for respectively guiding the movement of said first and second grip means; and a reciprocating driving means for driving said first and second moveable grip means in opposing directions relative to one another along their respective guide means for advancing said web when said first and second moveable grip means alternately engage said web;

wherein said driving means comprises a coupling member operatively connected to said first and second grip means and a means for driving said coupling member in a direction transverse to said forward feed direction to impart movement to said first and second grip means along said first and second guide means, respectively.

2. The device according to claim 1, wherein said means for driving the coupling member comprises an electrical element.

3. The device according to claim 1, wherein one of said first and second guide means is adjustable to vary the angle between the motion of a respective one of said grip means and the forward feeding direction.

4. The device according to claim 1, wherein the first and second grips include guide members for guiding the web.

5. The device according to claim 1, wherein said first and second grips are coupled with said coupling member through sliding coupling elements.

6. The feeding device according to claim 1, wherein said first and second guide means are oriented such that a direction of movement of the first and second grip means along said first and second guide means is inclined with respect to the forward feed direction, wherein said first and second grip means cooperate to move the web forward and at the same time transverse to the forward feed direction.

7. The device according to claim 6, wherein said first and second grip means comprise two grips, said first and second guide means comprise two guide rails, and said two grips each slidably engage a respective one of said two guide rails.

8. The device according to claim 7, wherein said two guide rails are oriented at opposing angles with respect to the forward feed direction.

9. The device according to claim 1, wherein the directions of motion of the first and second grip means are inclined to the forward feed direction.

10. The device according to claim 1, wherein said first and second guide means are oriented parallel with respect to the direction of the forward feed direction and said transverse movement of said coupling member is converted into parallel movement of said first and second grip means along said guide means by levers coupled between said coupling member and said first and second grip means.

11. The device according to claim 1, wherein said first and second grip means comprise a first and second grip and said first and second guide means comprise, respectively, a first pair of guide rails for guiding said first grip and a second pair of guide rails for guiding said second grip, wherein opposing ends of said first and second grips each slidably engage one of its respective pair of guide rails.

12. A method of feeding a web in a forward feed direction, comprising the steps of:

providing a first grip slidably mounted on a first guide oriented to provide a direction of motion of said first grip along said first guide having a component which is transverse to said forward feed direction of the web;

providing a second grip slidably mounted on a second guide oriented to provide a direction of motion of said second grip along said second guide having a component which is transverse to said forward feed direction, said direction of motion of said second grip opposing said direction of motion of said first grip;

providing a coupling member which is operatively connected to each of said first and second grips and drivable in a first direction transverse to said forward feed direction and a second direction opposite said first direction;

engaging the web with said first grip;

driving said first grip along said first guide from a first position to a second position to advance said web both forwardly and transversely, said step of driving said first grip comprising moving said coupling member in said first direction transverse to said forward feed direction to impart driving force to said first grip;

releasing the engagement between the web and said first grip;

engaging the web with said second grip; and driving said second grip from a third position to a fourth position to advance said web both forwardly and transversely thereby advancing said web in a zig-zag manner, said step of driving said second grip comprising moving said coupling member in said second direction opposite to said first direction to impart driving force to said second grip.

13. The method according to claim 12, wherein during the step of driving said second grip from a third position to a fourth position, said method further comprises the step of returning the first grip from said second position to said first position, and during the step of driving said first grip from a first position to a second position, said method further comprises the step of returning the second grip from said fourth position to said third position, and wherein the steps of alternately driving and returning the first and second grips are repeated as necessary to advance the web a predetermined amount.

14. The method according to claim 12, wherein the steps of providing said first and second grips further comprise providing an angle between the direction of motion of the first grip in relation to the forward feed direction that is different from the opposing angle between the axis of the direction of motion of the second grip in relation to the forward feed direction, wherein said steps of alternately driving and returning said first and second grids advances the web in a sawtoothed manner.

* * * * *